US006517449B2

(12) United States Patent
Otoguro

(10) Patent No.: US 6,517,449 B2
(45) Date of Patent: Feb. 11, 2003

(54) STRUCTURE OF HEAD IN IRON CLUB FOR GOLF

(75) Inventor: Masaaki Otoguro, Shizuoka-ken (JP)

(73) Assignee: Peparlet Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/969,648

(22) Filed: Oct. 4, 2001

(65) Prior Publication Data

US 2002/0042305 A1 Apr. 11, 2002

(30) Foreign Application Priority Data

Oct. 5, 2000 (JP) ..... 2000-306787

(51) Int. Cl.[7] ..... A63B 53/04
(52) U.S. Cl. ..... 473/328; 473/350
(58) Field of Search ..... 473/324, 327, 473/328, 344, 350; D21/743, 752, 753, 751

(56) References Cited

U.S. PATENT DOCUMENTS

D44,457 S * 8/1913 Taylor
1,089,881 A * 3/1914 Taylor
1,505,296 A * 8/1924 Smith
D212,293 S * 9/1968 Brown
3,719,359 A * 3/1973 Evans
3,830,503 A * 8/1974 Consoli
3,997,170 A * 12/1976 Goldberg
4,065,133 A * 12/1977 Gordos
4,869,508 A * 9/1989 Miller
5,000,455 A * 3/1991 Beilfuss
5,280,911 A * 1/1994 Katayama
5,603,668 A * 2/1997 Antonious
5,762,566 A * 6/1998 King

* cited by examiner

*Primary Examiner*—Sebastiano Passaniti
(74) *Attorney, Agent, or Firm*—Wenderoth, Lind & Ponack, L.L.P.

(57) ABSTRACT

To provide a structure of a head of an iron club for golf in which grass resistance during a shot can be extensively reduced, follow-through of the swing of the club head can easily be conducted in the rough even by beginners and powerless golfers, poor shots such as chips and shanks can effectively be eliminated, and safety is ensured by solving the problem of accidents resulting in injury and death by shanking, etc. The structure of the head of the iron club for golf includes grass relief grooves 5 which are formed in a leading edge portion zone 4 of the club head 1 such that the grass relief grooves 5 are open at a leading edge 4*a* and released at a surface 4*b* on the side of the striking face 2 of the leading edge portion zone 4 and at a surface 4*c* on the side of a sole face 3 of the leading edge portion zone 4.

4 Claims, 7 Drawing Sheets

FIG.3B
FIG.3A
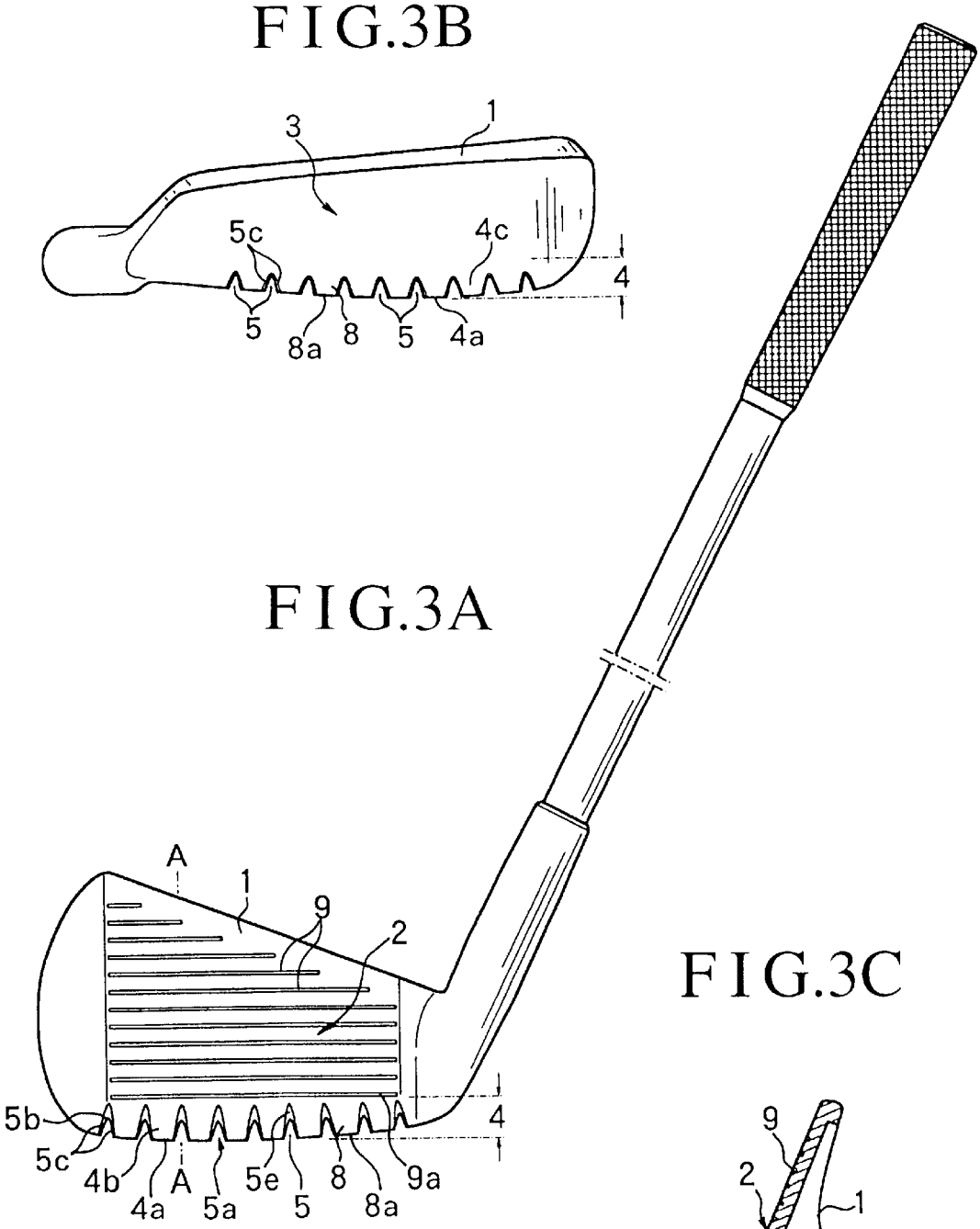
FIG.3C
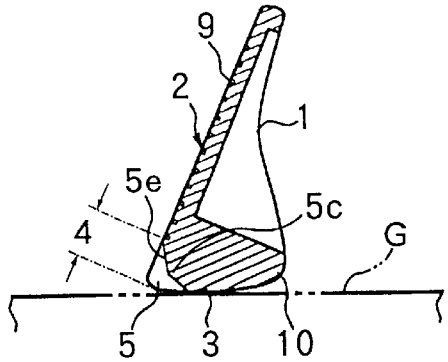

FIG.5B
FIG.5A
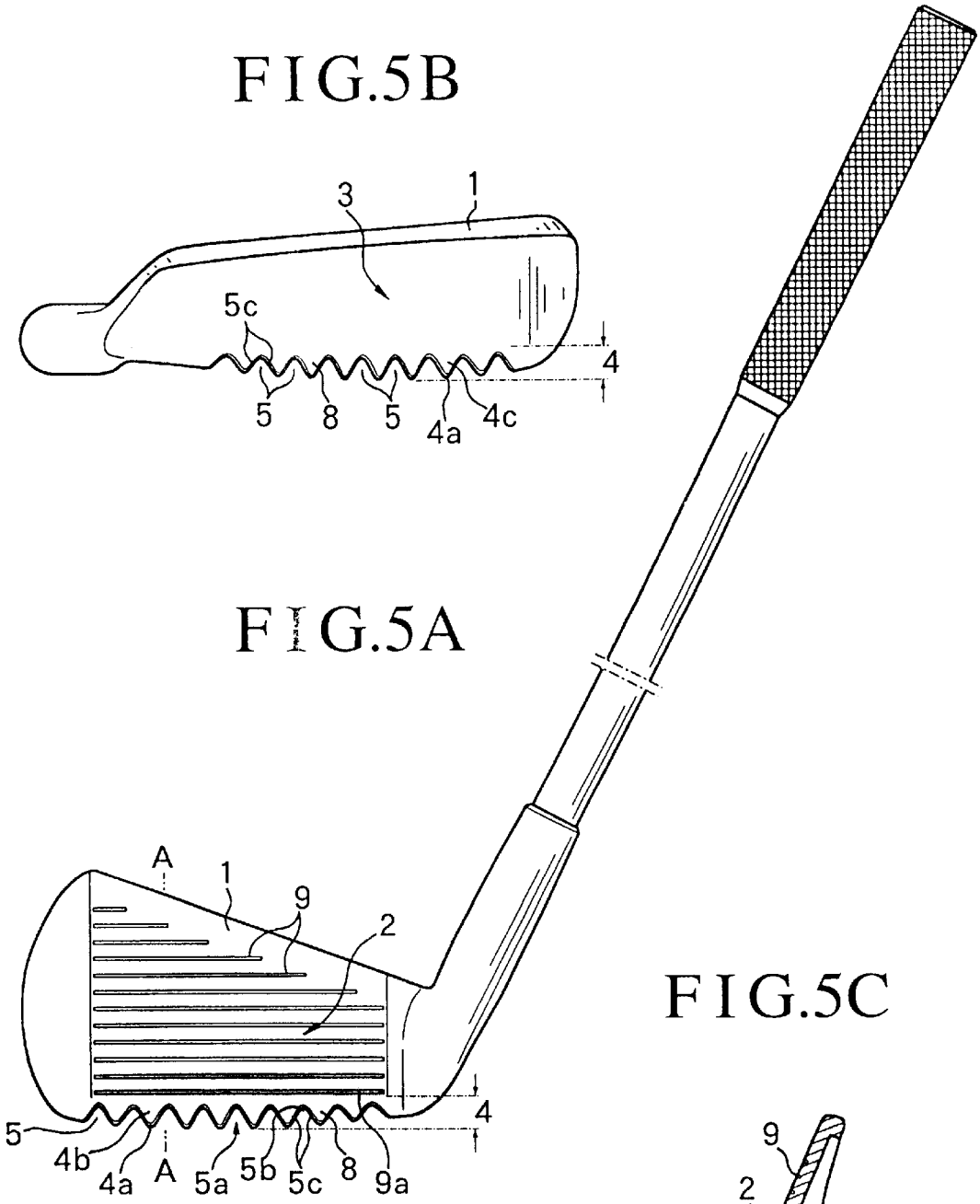
FIG.5C
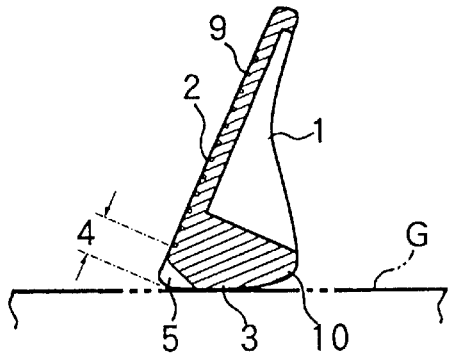

STRUCTURE OF HEAD IN IRON CLUB FOR GOLF

BACKGROUND OF THE INVENTION

1. Field of the Invention

This invention relates to a structure of a head of an iron club for golf which can offer an effective follow-through of a swing of the club head.

2. Related Art

A shot using an iron club, especially a shot from the rough involves various problems. Due to resistance from the grass, it is difficult to perform an ideal follow-through of the swing of the club head, and the angle of the striking face is readily swayed thus causing the trajectory of the golf ball to deviate greatly right or left. It also results in poor shots (missed shots) such as chips, shanks, hooks and the like, where the golfer cannot obtain an intended flight distance.

To make the golf ball escape from high rough, the technique of skilled players is required. The ability to effectively make the golf ball escape from the rough is very important for improving the score. This is especially so for beginners and powerless golfers. In particular, a shank raises a serious problem that the caddy and galleries are likely to get injured. Moreover, the twisting of the club shaft due to grass resistance and impact resistance can cause the player to suffer from wrist pain.

SUMMARY OF THE INVENTION

It is, therefore, an object of the present invention to provide a structure of a head of an iron club for golf in which grass resistance during the time can extensively be reduced, follow-through of the swing of a club head can easily be conducted in the rough even by beginners and powerless golfers, poor shots (missed shots) such as chips and shanks can effectively be eliminated, and safety is ensured by solving the problem of accidents resulting in injury and death by shanking, etc.

To achieve the above object, according to the present invention, a structure of a head of an iron club for golf includes grass relief grooves formed in a leading edge portion zone of a club head such that each grass relief groove is open at a leading edge and released at a surface on the side of the striking face of the leading edge portion zone and at a surface on the side of a sole face of the leading edge portion zone. With this construction of the present invention, grass resistance during a shot, especially, grass resistance or soil-resistance during a shot from the rough can be reduced by relieving grass or soil into the grass relief grooves.

Moreover, a grass cutter for cutting grass introduced into each grass relief groove is formed with an edge of a wall for defining the grass relief groove. With this construction of the present invention, the reduction of grass resistance during a shot can be improved by cutting the grass while allowing the grass to escape into the grass relief groove.

Owing to the above-mentioned construction, follow-through of the swing of a club head of an iron club can be conducted very easily, poor shots (misses shots) such as chips and shanks can effectively be eliminated, and the problem of accidents resulting in injury and death by shanking, etc can effectively be solved. In addition, the problem of injury of the player's wrist can be solved. Moreover, follow-through of the swing at the time of duffing can be conducted in a satisfactory manner.

BRIEF DESCRIPTION OF THE DRAWINGS

FIGS. 3(A)–3(C) show a third example of an iron club, with FIG. 3(A) being a plan view of a short iron club head with a striking face held in a generally horizontal posture, FIG. 3(B) being likewise a plan view with a sole face held generally in a horizontal posture, and FIG. 3(C) being a sectional view taken on line A—A of FIG. 3(A);

FIGS. 5(A)–5(C) show a fifth example of an iron club, with FIG. 5(A) being a plan view of a short iron club head with a striking face held in a generally horizontal posture, FIG. 5(B) being likewise a plan view with a sole face held generally in a horizontal posture, and FIG. 5(C) being a sectional view taken on line A—A of FIG. 5(A);

DETAILED DESCRIPTION OF THE INVENTION

Figure 1B:
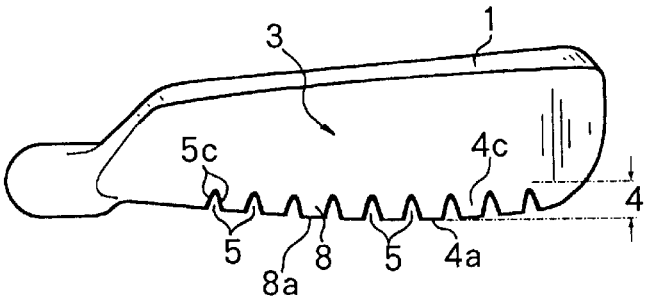
FIGS. 1(A)–(D) show a first example of an iron club, with FIG. 1(A) being a plan view of a short iron club head with a striking face held in a generally horizontal posture, FIG. 1(B) being likewise a plan view with a sole face held generally in a horizontal posture, FIG. 1(C) being a sectional view taken on line A—A of FIG. 1(A) and FIG. 1(D) being an enlarged sectional view taken on line B—B of FIG. 1(A)
Figure 1A:
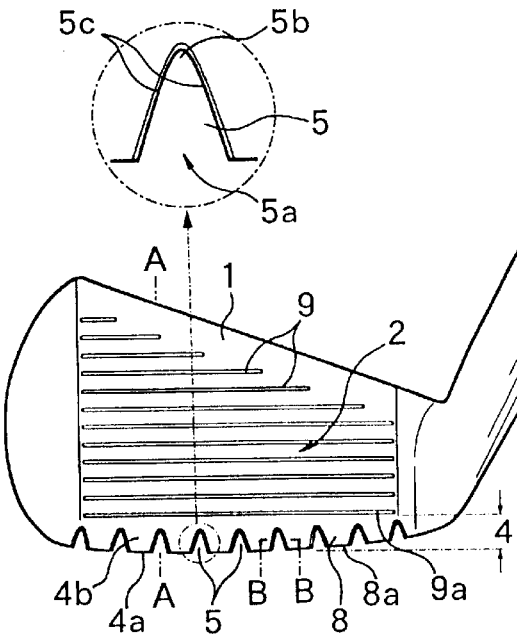
Figure 1C:
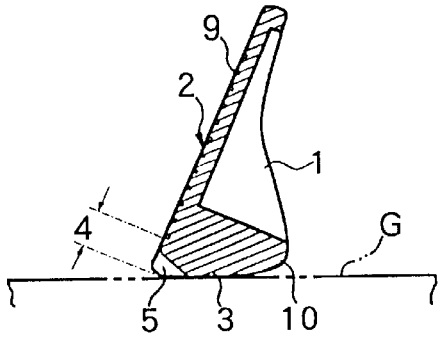
Figure 1D:
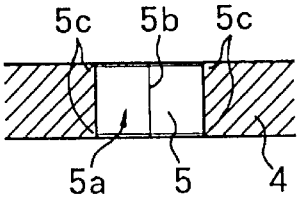

As shown in FIGS. 1(A) to 5(C), a single or plural grass relief grooves are formed in a leading edge portion zone 4 of an iron club head 1.

In other words, a single or plural grass relief grooves 5 are formed in the leading edge portion zone 4 of the club head 1 such that each grass relief groove 5 is open at a leading edge 4*a* of the leading edge portion zone 4 and released at a surface 4*b* on the side of the striking face 2 of the leading edge portion zone 4 and at a surface 4*c* on the side of a sole face 3 of the leading edge portion zone 4.

The length of the grass relief grooves 5 is such that the grooves terminate before reaching a sweet spot region of the striking face 2.

A plurality of ball spinning grooves 9 generally parallel to the leading edge 4*a* are formed in juxtaposed relation in the striking face 2 of the club head 1 of the iron club. Those ball spinning grooves 9 are for applying reverse rotation to a golf ball. Preferably, the grass relief grooves 5 do not reach the lowermost ball spinning groove 9*a*. In other words, the grass relief grooves 5 terminate just before reaching the ball spinning groove 9*a*. Otherwise, the grass relief grooves 5 terminate at a length such that they reach the two or three lower end ball spinning grooves 9 of the ball spinning grooves 9. At any rate, it is preferable that the grass relief grooves 5 are terminated before reaching the sweet spot.

In the illustrated examples, inner depths 5*b* of the grass relief grooves 5 are arranged in juxtaposed relation in the leading edge portion zone 4 between the lowermost end ball spinning groove 9*a* and the leading edge 4*a*.

Each grass relief groove 5 is a means for reducing grass resistance during the shot, especially grass resistance during a shot from the rough or soil resistance when duffing and during bunker shots by relieving grass 6 or soil into the grass relief groove 5. The number of the grass relief grooves 5 is determined by selecting the dimension and shape of the opening portion 5*a* in accordance with a loft angle of the striking face 2 and the club number.

As one preferred example, a plurality of grass relief grooves 5 are formed in juxtaposed relation in the leading edge portion zone 4, in other words, from one end over to the other end of the leading edge portion zone 4, and an edge piece 8 is formed between each adjacent pair of grass relief grooves 5. In other words, a plurality of edge pieces 8 are arranged in juxtaposed relation in the leading edge portion zone 4 and the grass relieve grooves 5 are formed between adjacent edge pieces 8.

As one specific example, as shown in FIGS. 1(A)–1(D) as well as other figures, the grass relief grooves 5 are spaced apart in juxtaposed relation in the leading edge portion zone 4, in other words, along the leading edge 4*a,* and the rectangular edge pieces 8 are formed between adjacent grass relief grooves 5. Each rectangular edge piece 8 has a top side 8*a* of a predetermined width which is formed on a distal end of the rectangular edge piece 8.

At the time of a shot, a part of the grass 6 or soil is in abutment with the top side 8*a* of the rectangular edge piece 8 and the remaining part is relieved into the relief groove 5.

As another specific example, as shown in FIGS. 5(A)–5(C), the grass relief grooves 5 and edge pieces 8 are sinusoidally formed in juxtaposed relation in the leading edge portion zone 4, in other words, along the leading edge 4*a*. The grass relief groove 5 has an arc-like recessed configuration. Likewise, the edge piece 8 exhibits an arc-like protrusion configuration. The grass relief groove 5 has a form in which the width is gradually reduced from the opening portion 5*a* towards the inner depth 5*b* of the groove 5.

As one preferred example, the grass relief groove 5 has a form which is open at the opening portion 5*a* and gradually converged towards the inner depth 5*b* of the groove 5. In other words, it has a form which is gradually enlarged from the inner depth 5*b* of the groove 5 towards the opening portion 5*a*. That is to say, the grass relief groove 5 has a groove form having a generally V-shaped configuration as shown in FIGS. 1(A)–1(D) and 5(A)–5(C) which is open at the opening portion 5*a* and gradually contracted toward the inner depth 5*a* of the groove 5.

The grass 6 is introduced from the enlarged (or dilated) opening portion 5*a* of the grass relief groove 5 and converged towards the contracted inner depth 5*b* of the groove 5. In doing so, a swing stroke is guided.

The grass relief groove 5 may take any one or any combination of a V-shape, rectangular shape, arc-shape, trapezoidal shape and the like as needed. The term "V-shape" herein used includes a U-shape.

Figure 6A:
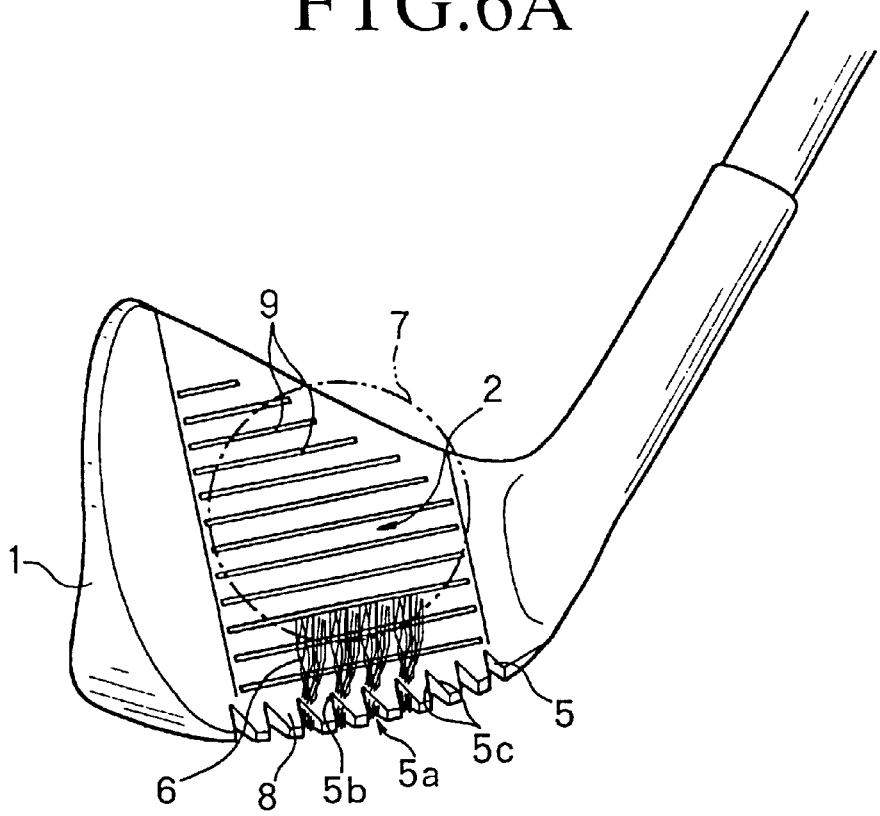
FIG. 6(A) is a perspective view showing a state of the above iron club when being used.
Figure 6B:
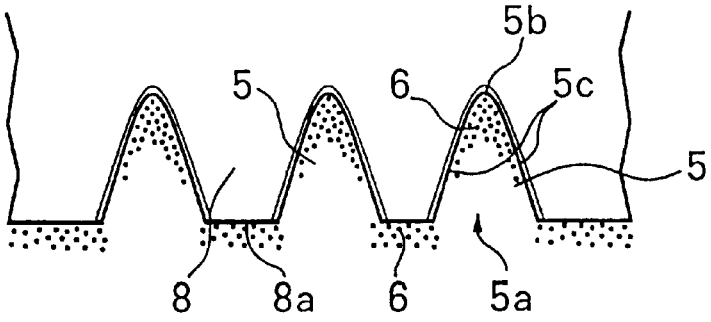
FIG. 6(B) is an enlarged plan view of a grass relief groove portion.

As shown in FIGS. 6(A) and 6(B), during a shot, the grass relief grooves 5 allow that portion of grass corresponding to the grass relief grooves 5 to be relieved therein and the golf ball 7 is caught at the striking face 2. In doing so, grass resistance at the time of the shot is reduced and swaying of the club head 1 can be prevented more effectively. The follow-through of the swing of the club head 1 can be conducted in a satisfactory manner and the golf ball 7 can be made to travel on a correct trajectory.

As one embodiment, a cutter 5*c* for cutting the grass introduced into each grass relieve groove 5 is formed by a wall which defines the grass relief groove 5. The cutter 5*c* together with the grass relieve groove 5 cuts most of the grass 6 introduced into the grass relief groove 5 and the golf ball 7 is caught at the striking face 2. This can further reduce the grass resistance and grass entanglement at the time of the shot. And swaying of the club head 1 can be prevented more effectively.

The grass 6 is introduced into each V-shaped grass relief groove 5 from the enlarged opening portion 5*a* and converged towards the contracted inner depth 5*b* of the groove 5. Owing to this arrangement, the grass cutting by the grass cutter 5*c* is further improved.

FIGS. 1(A) to 1(D) show an example in which groove edge portions facing the surface 4*b* on the side of the striking face of the leading edge portion zone 4 and groove edge portions facing a surface 4*c* on the side of the sole face are used as the cutters 5*c*.

Figure 2B:
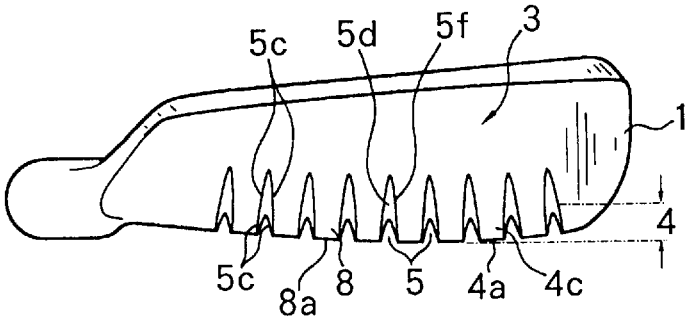
FIGS. 2(A)–2(C) show a second example of an iron club, with FIG. 2(A) being a plan view of a short iron club head with a striking face held in a generally horizontal posture, FIG. 2(B) being likewise a plan view with a sole face held generally in a horizontal posture, and FIG. 2(C) being a sectional view taken on line A—A of FIG. 2(A)
Figure 2A:
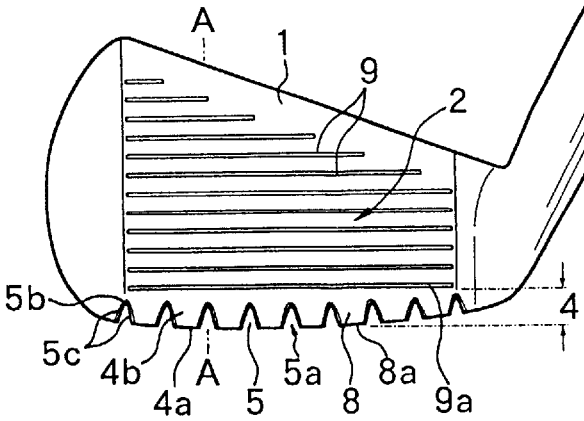
Figure 2C:
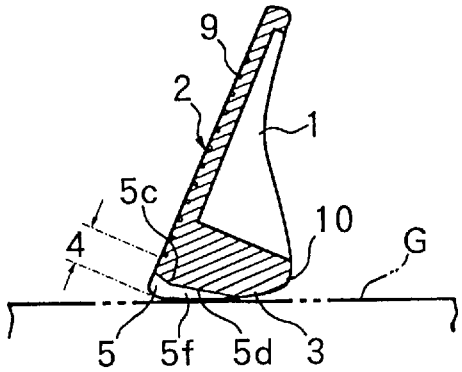

As another example, as shown in FIGS. 2(A) to 2(C), grass relief inclination surfaces 5*d,* which are inclined downward towards the grass relief grooves 5, are formed on a peripheral edge of the surface 4*c* on the side of the sole face of the leading edge portion zone 4 of the V-shaped grass relief grooves 5, for example, the peripheral edge of the surface 4*c* on the side of the sole face of the leading edge portion zone 4 of the inner depths 5*b* of the grass relief grooves 5. By forming the grass relief inclination surfaces 5*d,* generally V-shaped grass guide grooves 5*f* are formed along the grass relief inclination surfaces 5*d* and grass cutters 5*c* are formed on end portions of the grass relief inclination surfaces 5*d*.

It is preferred that the grass relief inclination surfaces 5*d* and the grass guide grooves 5*f* are designed to be relatively long so that they have V-shaped configurations in plan view. For example, the length of each grass relief inclination surface 5*d* and each grass guide groove 5*f* is once or twice as long as the depth of the grass relief groove 5 or more. They are each designed to have a V-shaped configuration.

The grass relief inclination surface 5*d* and the grass guide groove 5*f* serve to effectively relieve the grass that is received into the grass reliefgroove 5 and has fallen to the sole face 3 side, to reduce the follow-through swinging power and guide the follow-through swinging direction, and to prevent deviation of the angle of the striking face 2.

As still another example, as shown in FIGS. 3(A) to 3(C), grass relief inclination surfaces 5*e,* which are inclined downward towards the grass relieve grooves 5, are formed on a peripheral edge of the surface 4*b* on the side of the striking face of the leading edge portion zone 4 of the V-shaped grass relief grooves 5, for example, the peripheral edge of the surface 4*b* on the side of the striking face of the leading edge portion zone 4 of the inner depths 5*b* of the grass relief grooves 5, and grass cutters 5*c* are formed on end portions of the inclination surfaces 5*e*.

Figure 4B:
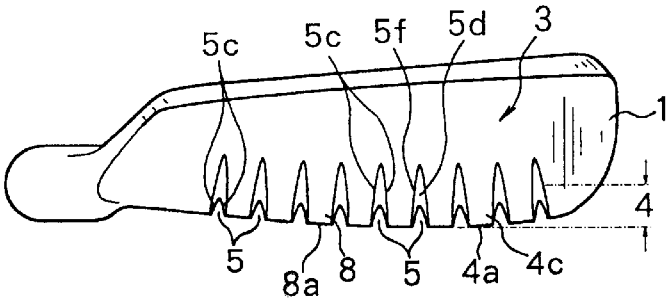
FIGS. 4(A)–4(C) show a fourth example of an iron club, with FIG. 4(A) being a plan view of a short iron club head with a striking face held in a generally horizontal posture, FIG. 4(B) being likewise a plan view with a sole face held generally in a horizontal posture, and FIG. 4(C) being a sectional view taken on line A—A of FIG. 4(A)
Figure 4A:
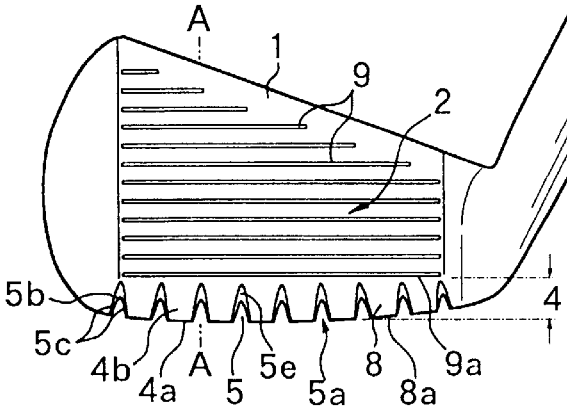
Figure 4C:
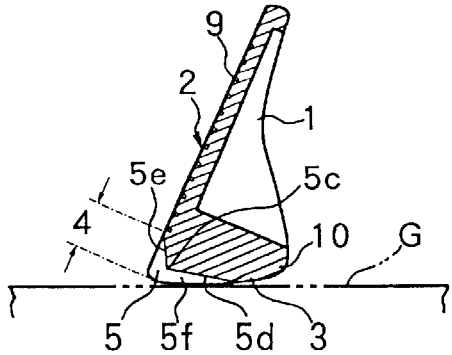

As still another example, as shown in FIGS. 4(A) to 4(C), generally V-shaped short grass relief inclination surfaces 5*e,* which are inclined downward towards the grass relief grooves 5, are formed on a peripheral edge of the surface 4*b* on the side of the striking face of the leading edge portion zone 4 of the V-shaped grass relief grooves 5, for example, the peripheral edge of the surface 4*b* on the side of the striking face of the leading edge portion zone 4 of the inner depths 5*b* of the grass relief grooves 5. Moreover, generally V-shaped long grass relief inclination surfaces 5*b* like the ones shown in FIGS. 2(A)–2(C), which are inclined downward towards the grass relief grooves 5 and grass guide grooves 5*f* are formed on a peripheral edge of the surface 4*c* on the side of the sole face of the leading edge portion zone 4 of the V-shaped grass relief grooves 5, for example, the peripheral edge of the surface 4*c* on the side of the sole of the leading edge portion zone 4 of the inner depths 5*b* of the grass relief grooves 5. And grass cutters 5*c* are formed on end portions of the inclination surfaces 5*d*, 5*e*.

Any example of FIGS. 3(A)–3(C) and 4(A)–4(C) includes a case which is further provided with grass cutters 5*c* formed by the V-shaped edge portions of the grass relief grooves 5 as described with reference to FIGS. 2(A)–2(C).

The grass relief inclination surfaces 5*e* are terminated in length so as to at least not reach the sweet spot region of the striking face 2.

As one preferred example, the grass relief inclination surfaces 5*e* are terminated in length so as to not reach the ball spinning groove 9*a* located at the lowermost end of the grass relief inclination surfaces 5*e*, in other words, the ball spinning groove 9*a* located nearest to the leading edge 4*a*, or just reaching the ball spinning groove 9*a*. Otherwise, the grass relief inclination surfaces 5*e* are terminated in length so as to just reach approximately the lowermost two to four ball spinning grooves 9. At any rate, they are terminated in length so as to not reach the sweet spot.

In the illustrated example, the end portions of the grass relief inclination surfaces 5*e* are arranged in juxtaposed relation in the leading edge portion zone 4 between the lowermost end ball spinning groove 9*a* and the leading edge 4*a*.

The grass relief inclination surfaces 5*d* and the grass guide grooves 5*f* of FIGS. 2(A)–2(C) and 4(A)–4(C) are terminated in length so as to not reach the rear edge 10 of the sole face 3. Preferably, they are designed to be about two to three times as long as the grass relief inclination surfaces 5*e*. At any rate, they are preferably designed to have a length so as to not reach the sweet spot.

It should be noted, however, the present invention does not exclude an embodiment in which the grass relief inclination surfaces 5*d* and the grass guide grooves 5*f* are designed to have lengths so as to reach the rear edge 10.

Figure 7A:
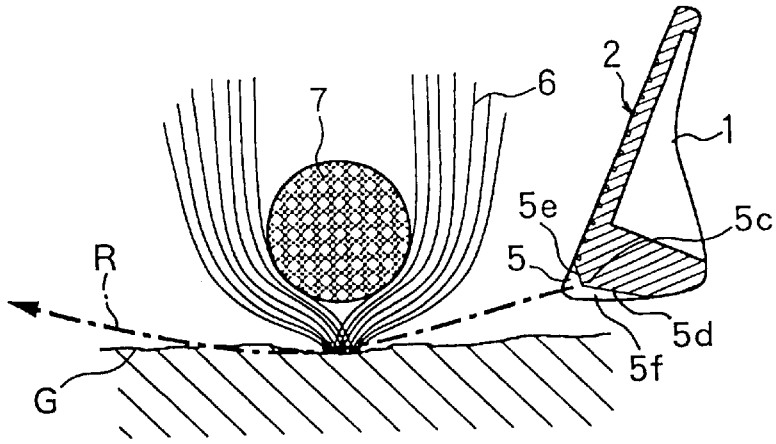
FIGS. 7(A)–7(C) are sectional views for explaining a state of the iron club being used, by separately and sequentially showing a swing stroke of the iron club.
Figure 7B:
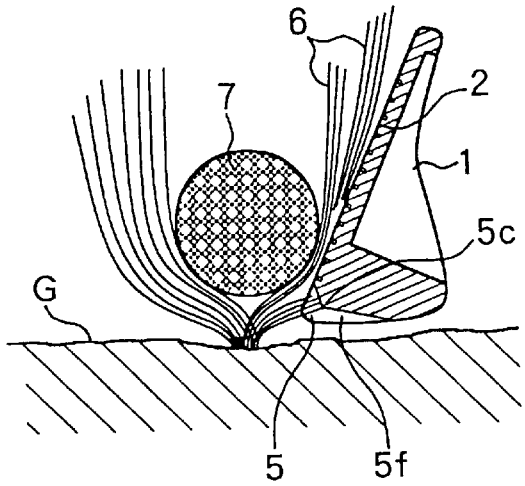
Figure 7C:
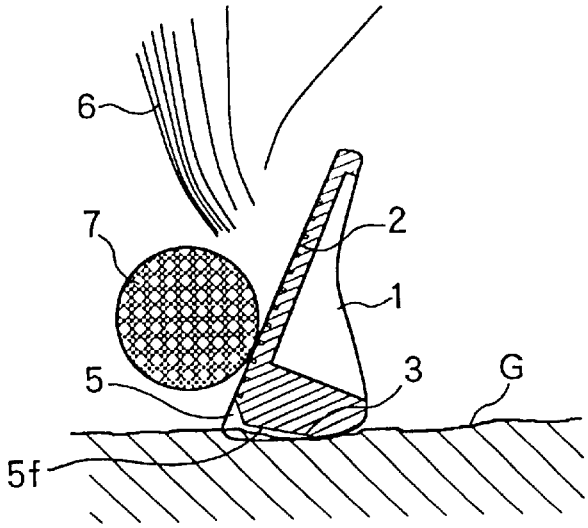

As shown in FIGS. 7(A)–7(C), the club head 1 shown in each of the above examples is fully swung (follow-through swing) on the trajectory R and brought to a location a little before the golf ball 7 as shown in FIG. 7(A). At that time, rough grass 6 is interposed between the golf ball 7 and the leading edge 4*a* of the club head 1. Reference character G denotes the ground.

When the swinging stroke progresses further, as shown in FIG. 7(B), the grass 6 is allowed to relieve into the relief grooves 5. While the grass cutters 5*c* cut a part of the grass 6, a lower face of the golf ball 7 is contacted by the surface 4*b* on the side of the striking face of the leading edge portion zone 4. Then, while throwing the cut grass 6 upward and away as shown in FIG. 7(C), the golf ball 7 is caught by the nearby area of the sweet spot of the striking face 2 and caused to travel in the right direction.

In FIG. 7(B), the uncut and fallen grass 6 is guided by the grass relief inclination surfaces 5*d* and the grass guide grooves 5*f* and in the meantime, the club head 1 is fully swung.

According to the present invention, grass resistance at the time of the shot can be reduced extensively, follow-through of the swing of a club head can easily be conducted in the rough even by beginners and powerless golfers, poor shots (missed shots) such as chips and shanks can effectively be eliminated, and safety is ensured by solving the problem of accidents resulting in injury and death by shanking, etc.

Moreover, according to the present invention, even if duffing occurs, by reducing the ground resistance by means of allowing a part of the soil into the grass relief grooves, the leading edge portion that bites into the ground can be brought out smoothly. In this manner, poor shots (missed shot) caused by duffing can be minimized.

What is claimed is:

1. A club head for a golf iron, comprising:

a striking face arranged for striking a golf ball;

a sole face arranged to rest on a ground surface and extending rearwardly from a lower end of said striking face;

a leading edge portion zone defined at an intersection portion of said sole face and the lower end of said striking face;

wherein a plurality of grass relief grooves are formed in said leading edge portion zone so as to be spaced apart along said leading edge portion zone and so as to extend from said striking face through said sole face;

wherein each of said grass relief grooves has a groove surface that is generally V-shaped so that each of said grass relief grooves narrows upwardly from an opening portion thereof to an inner depth portion thereof, such that, when said club head is swung through grass, the grass is introduced into each of said grass relief grooves at said opening portion thereof and is caused to converge toward said inner depth portion of each of said grass relief grooves;

wherein grass relief inclination surfaces are formed in said sole face so as to extend rearwardly from said grass relief grooves, respectively, and form generally V-shaped grass guide grooves, said grass relief inclination surfaces being inclined relative to said groove surfaces of said grass relief grooves, respectively, when viewed from an end of said club head; and wherein grass cutters are formed on end portions of said grass relief inclination surfaces, respectively.

2. The club head for a golf iron, according to claim 1, wherein the end portions of said grass relief inclination surfaces at which said grass cutters are formed constitute intersections of said grass relief inclination surfaces with said groove surfaces of said grass relief grooves, respectively.

3. A club head for a golf iron, comprising:

a striking face arranged for striking a golf ball;

a sole face arranged to rest on a ground surface and extending rearwardly from a lower end of said striking face;

a leading edge portion zone defined at an intersection portion of said sole face and the lower end of said striking face;

wherein a plurality of grass relief grooves are formed in said leading edge portion zone so as to be spaced apart along said leading edge portion zone and so as to extend from said striking face through said sole face;

wherein each of said grass relief grooves has a groove surface that is generally V-shaped so that each of said grass relief grooves narrows upwardly from an opening portion thereof to an inner depth portion thereof, such that, when said club head is swung through grass, the grass is introduced into each of said grass relief grooves at said opening portion thereof and is caused to converge toward said inner depth portion of each of said grass relief grooves;

wherein grass relief inclination surfaces are formed in said striking face so as to extend upwardly from front end portions of said grass relief grooves, respectively, and form generally V-shaped grass guide grooves, said grass relief inclination surfaces being inclined relative to said groove surfaces of said grass relief grooves, respectively, when viewed from an end of said club head; and wherein grass cutters are formed on end portions of said grass relief inclination surfaces, respectively.

4. The club head for a golf iron, according to claim 3, wherein the end portions of said grass relief inclination surfaces at which said-grass cutters are formed constitute intersections of said grass relief inclination surfaces with said groove surfaces of said grass relief grooves, respectively.

* * * * *